US012729486B2

(12) United States Patent
Bliss et al.

(10) Patent No.: US 12,729,486 B2
(45) Date of Patent: Sep. 8, 2026

(54) FOAM-ASSISTED APPLICATION OF UNCOOKED STARCH AND DRY STRENGTH AGENTS TO PAPER PRODUCTS

(71) Applicant: SOLENIS TECHNOLOGIES, L.P., Wilmington, DE (US)

(72) Inventors: Terry Lynn Bliss, Marietta, GA (US); Matthew Nicholas, Avondale, PA (US); Stephen Vinciguerra, West Grove, PA (US); Ashley Hawkins Lewis, Wilmington, PA (US)

(73) Assignee: SOLENIS TECHNOLOGIES, L.P., Wilmington, DE (US)

( * ) Notice: Subject to any disclaimer, the term of this patent is extended or adjusted under 35 U.S.C. 154(b) by 538 days.

(21) Appl. No.: 18/057,837

(22) Filed: Nov. 22, 2022

(65) Prior Publication Data

US 2023/0160147 A1 May 25, 2023

Related U.S. Application Data

(60) Provisional application No. 63/264,581, filed on Nov. 25, 2021.

(51) Int. Cl.
*D21F 11/00* (2006.01)
*D21H 17/28* (2006.01)
(Continued)

(52) U.S. Cl.
CPC ..... *D21H 27/30* (2013.01); *D21F 11/002* (2013.01); *D21H 17/28* (2013.01); *D21H 17/56* (2013.01)

(58) Field of Classification Search
CPC ..... D21H 27/30; D21H 17/28; D21H 17/56; D21H 19/54; D21H 21/16; D21H 21/56;
(Continued)

(56) References Cited

U.S. PATENT DOCUMENTS 3,210,240 A 10/1965 Read et al.
4,099,913 A 7/1978 Walter et al.
(Continued)

FOREIGN PATENT DOCUMENTS

CN 102733267 A 10/2012
CN 104285006 A 1/2015
(Continued)

OTHER PUBLICATIONS

XP086481679; Arancibia Fernando et al: "Stabilization of the emulsion of Alkenyl Succinic Anhydride (ASA) in water using cellulose nanofibrils", Chemical Engineering Science, Oxford, GB, vol. 233, Jan. 5, 2021 (Jan. 5, 2021), ISSN: 0009-2509, DOI: 10.1016/J.CES.2020.116407 [retrieved on Jan. 5, 2021] * Sections 2.3 and 2.7 *.

*Primary Examiner* — Abbas Rashid
(74) *Attorney, Agent, or Firm* — Ingrassia Fisher & Lorenz LLP

(57) ABSTRACT

Multi-ply paper products and methods for manufacturing such products are provided. A method includes producing a foam of water, air, a foaming agent, uncooked starch, and a dry strength agent; applying the foam to a first surface of a base embryonic ply web; providing an applied embryonic ply web having a first surface and contacting the first surface of the base web with the first surface of the applied web at an interface to form a combined ply web; and selectively applying vacuum pressure to a second surface of the base web to retain particles of the uncooked starch on or near the first surface, to draw molecules of the dry strength agent into the base web and/or to the first surface of the applied web to retain particles of the uncooked starch in the interface and to draw molecules of the dry strength agent into the applied web.

20 Claims, 8 Drawing Sheets

(51) Int. Cl.
*D21H 17/56* (2006.01)
*D21H 27/30* (2006.01)

(58) Field of Classification Search
CPC ..... D21H 27/32; D21H 27/40; D21F 11/002; D21F 9/006; D21F 11/04
See application file for complete search history.

(56) References Cited

U.S. PATENT DOCUMENTS

| | | | |
|---|---|---|---|
| 4,184,914 | A | 1/1980 | Jenkins |
| 4,263,344 | A | 4/1981 | Radvan et al. |
| 4,353,993 | A | 10/1982 | McCrossin |
| 4,571,360 | A | 2/1986 | Brown et al. |
| 4,597,831 | A | 7/1986 | Anderson |
| 5,672,249 | A | 9/1997 | Vinson et al. |
| 5,851,352 | A | 12/1998 | Vinson et al. |
| 5,928,472 | A | 7/1999 | Evans et al. |
| 6,761,800 | B2 | 7/2004 | Capizzi |
| 6,797,116 | B2 | 9/2004 | Capizzi |
| 6,852,196 | B2 | 2/2005 | Capizzi |
| 6,875,308 | B2 | 4/2005 | Kajander et al. |
| 6,977,026 | B2 | 12/2005 | Liu et al. |
| 7,285,183 | B2 | 10/2007 | Kajander et al. |
| 10,106,932 | B2 | 10/2018 | Anderson et al. |
| 11,365,515 | B2 | 6/2022 | Luo et al. |
| 12,258,715 | B2 | 3/2025 | Backfolk et al. |
| 2003/0221808 | A1 | 12/2003 | Capizzi |
| 2008/0066881 | A1* | 3/2008 | Riehle ..... C08G 73/0286 162/164.3 |
| 2019/0309480 | A1* | 10/2019 | Luo ..... D21H 19/10 |
| 2021/0002830 | A1 | 1/2021 | Hietaniemi |
| 2022/0243401 | A1 | 8/2022 | Backfolk et al. |
| 2023/0002974 | A1* | 1/2023 | Hemphill ..... B32B 9/02 |
| 2023/0160147 | A1 | 5/2023 | Bliss et al. |
| 2023/0279614 | A1 | 9/2023 | Lewis et al. |
| 2024/0229361 | A9 | 7/2024 | Kiviranta et al. |

FOREIGN PATENT DOCUMENTS

| | | | |
|---|---|---|---|
| CN | 112218930 | A | 1/2021 |
| CN | 113631774 | A | 11/2021 |
| CN | 118661003 | A | 9/2024 |
| EP | 0195459 | A1 | 9/1986 |
| SE | 1651026 | A1 | 5/2021 |
| SE | 543902 | C2 | 9/2021 |
| WO | 2010111899 | A1 | 10/2010 |
| WO | 2020230035 | A1 | 11/2020 |

* cited by examiner

FOAM-ASSISTED APPLICATION OF UNCOOKED STARCH AND DRY STRENGTH AGENTS TO PAPER PRODUCTS

CROSS-REFERENCE TO RELATED APPLICATION

This application claims the benefit of U.S. Provisional Application No. 63/264,581, filed Nov. 25, 2021, which is hereby incorporated in its entirety by reference.

TECHNICAL FIELD

The present disclosure relates to the field of applying additives to wet paper webs. More particularly, the present disclosure relates to the application of uncooked starch and synthetic, bio-based, or natural strength agents using foamed application techniques to wet newly-formed webs in the production of multi-ply paperboard.

BACKGROUND

In paper manufacturing, additives are introduced into the papermaking process to improve paper properties. For example, known additives improve paper strength, drainage properties, retention properties, and so on.

In a conventional papermaking machine, pulp is prepared for papermaking in a stock preparation system. Chemical additives, dyes, and fillers are sometimes added into the thick stock portion of the stock preparation system, which operates at a consistency of from 2.5 to 5% dry solids; additives may be added into the blend chest, the paper machine chest, a pulp suction associated with either of these chests, or other locations. In the thin stock circuit of the stock preparation system, the pulp is diluted from a consistency of 2.5 to 3.5% to a consistency of from 0.5 to 1.0% dry solids prior to passing through the thin stock cleaners, screens, an optional deaeration system, and approach flow piping. During or after this dilution, additional chemical additives may be added to the pulp, either in a pump suction, or in the headbox approach flow piping. Addition of chemical additives in the thick stock or the thin stock portions of the stock preparation system would be considered "wet-end addition" as used herein.

The fully prepared stock slurry, at from 0.5 to 1.0% dry solids consistency, is typically pumped to the headbox, which discharges the stock slurry onto a moving continuous forming fabric. The forming fabric may have the form of a woven mesh. Water drains through the forming fabric and the fibers are retained on the forming fabric to form an embryonic web while traveling from the headbox to the press section. As water drains away, the water content of the embryonic web may drop from 99 to 99.5% water to 70 to 80% water. Further water may be removed by pressing the wet web with roll presses in a press section, from which the wet web may exit with only from 50 to 60% water content (that is, a consistency of from 40 to 50% dry solids). Further water is typically removed from the web by evaporation in a dryer section, from which the web may exit with a consistency of from 90 to 94% dry solids. The sheet may then be calendered to improve the surface smoothness of the sheet, and to control the sheet thickness or density to a target value. The sheet is typically then collected on a reel.

As explained above, chemical additives, such as strength agents, may be introduced into the pulp within the stock preparation section, in what is known as "wet-end addition". In some cases, strength agents may also be added via either spraying onto the wet web in the forming section, or by using a size press to apply the additives to the dry sheet. Spray application and size press addition of additives are optional.

In wet-end applications, the chemical additives are distributed throughout the web and the retention of the chemical additives varies depending on the papermaking system and the chemistry being applied. There are additional considerations with wet-end application of additives such as deposits on the forming fabric and other surfaces within the forming section, and potential cycle up issues (accumulation of wet-end additives within the recirculated water due to poor fixation of the additives to the fibers). Spray application can be somewhat problematic due to accumulation of overspray on nearby surfaces and the plugging of the spray nozzles. Size press applications are not performed on the wet end of the papermaking machine and do not have the advantages of applying chemistry to a wet sheet prior to or during formation.

Further, chemical additives applied via traditional wet-end application typically provide relatively uniform distribution of additives throughout the Z-direction of the web, which may be desirable, or may result in less additive in some Z-direction locations within the sheet than desired. Thus, the wet end approach is not targeted and can result in some cost inefficiencies in the chemistry application.

In particular, some paperboard products are formed from multiple plies. The individual plies may advantageously be comprised of different types of fiber. This may be done to improve the properties of the sheet, or for cost savings reasons. In a three-ply sheet, the plies may be identified as the top ply (usually the preferred printing surface), the middle ply, and the back ply, which may or may not be printed. Typically the fibers used in the middle ply may be less costly or higher in bulk due to lack of bleaching or due to less refining or due to the fiber species or pulp production process, while the fibers in the top ply may be brighter and may produce a smoother printable surface. The back ply may be somewhat in between the cost and characteristics of the top and middle ply, or it may be very similar to the top ply if both sides are to be printed. Typically, the mass per unit area of top ply and the back ply is minimized, to reduce the total cost. Typically, the middle ply has more mass per unit area than the top or back ply, especially if the sheet is exceptionally thick. Typically, all broke from the production process is sent to the middle ply, to preserve the appearance and printing qualities of the top ply, and, in some cases, the back ply.

There are many ways to produce sheets with separate stock characteristics in the various plies, including specialized headboxes which have separate inlets for the separate stocks, and vanes within the headbox that keep the stocks separate until they discharge from the headbox toward the forming fabric. This method is sometimes called "wet on wet" forming and has been well known by those skilled in the art for at least 35 years. Such a forming technique produces very good bonding between the plies, but the layer purity is not as good as preferred, and the drained waters from the different plies are generally mixed, which can cause some process problems during the reuse of the drained water in the forming section. This is especially true when there are large differences in the brightness of the top ply or the top and back ply, relative to the middle ply.

Another method well known to those skilled in the art is the use of a secondary headbox, which can apply a top ply onto a base or center ply while the base or center ply is at about 8 to 10% solids on the forming table. This method is sometimes called "wet on dry" multi-ply forming, since the base or middle ply has been partially dewatered prior to application of the very low consistency stock that will become the top ply. Such a forming technique typically provides better layer purity, and reasonably good bonding between the plies, but the water from the top ply is still somewhat mixed with the base or middle ply water as the combined sheet drains. The secondary headbox method of forming multi-ply (usually two ply) sheets has also been widely practiced for many years.

Yet another widely practiced method of forming multi-ply sheets is by producing a top ply on a papermaking former, and a middle ply on a second papermaking former. Occasionally, multiple middle plies may be produced on multiple separate papermaking formers. Yet another separate papermaking former may be used to produce a bottom ply. The plies are bonded together by lightly pressing one ply into another with a "combining roll" at about 8 to 12% solids after which the sheet may be further dewatered by application of additional vacuum to the combined sheet. Such papermaking forming sections are well known to those skilled in the art, and the technique may be called "dry on dry" forming, because the plies are separately dewatered to from 8 to 12% solids before they are combined. This method of forming produces exceptionally good layer purity, and also provides for the best separation of the water systems of the named plies. It is also known to those skilled in the art that the "dry on dry" forming technique has less effective bonding between the various plies, which sometimes results in delamination in the ply bond area during printing.

Ply bonding can be improved in multi-ply formed sheets, and particularly in "dry on dry" formed multi-ply sheets, by spraying a suspension of uncooked starch on one of the ply surfaces where ply bonding is insufficient. The uncooked starch is in the form of small particles which are retained by filtration on the application surface of the ply. The particles of uncooked starch absorb water over time, particularly as the sheet heats up in the dryer section, and with sufficient moisture and temperature, will gelatinize and form an adhesive bond between the fibers of the plies it contacts, thus improving ply bonding.

It is understood that if a unique stock composition is to be provided to different plies of a multi-ply sheet, a separate stock preparation system is required for each ply. The need for separate top ply, middle ply, and back ply stock preparation and forming sections make this multi-ply sheet forming method complex and capital intensive compared to sheets with only one ply, or with uniform composition in two or more of their plies.

Further improvements in bonding-related paper strength parameters, such as the in-plane and Z-Direction Tensile strength, are desirable.

BRIEF SUMMARY

This summary is provided to introduce a selection of concepts in a simplified form that are further described below in the detailed description section.

In an exemplary embodiment, a method for manufacturing a multi-ply paper sheet is provided. The method includes producing a foam of water, air, a foaming agent, uncooked starch, and a dry strength agent; applying the foam to a first surface of a base embryonic ply web, wherein the base embryonic ply web has a second surface opposite the first surface; providing an applied embryonic ply web having a first surface and an opposite second surface and contacting the first surface of the base embryonic ply web with the first surface of the applied embryonic ply web at an interface to form a combined ply web; and selectively applying vacuum pressure to the second surface of the base embryonic ply web to retain particles of the uncooked starch on or near the first surface of the base embryonic ply web, to draw molecules of the dry strength agent into the base embryonic ply web and/or to the first surface of the applied embryonic ply web to retain particles of the uncooked starch in the interface and to draw molecules of the dry strength agent into the applied embryonic ply web.

In another exemplary embodiment, a method for introducing a dry strength agent into a multi-ply paper product is provided and includes producing a foam from a foaming formulation, the foaming formulation comprising: a foaming agent; uncooked starch; a dry strength agent; and water; and applying the foam to a wet embryonic ply web.

In another exemplary embodiment, a multi-ply paper product is provided. The multi-ply paper product is manufactured by producing a foam of water, air, uncooked starch, and a dry strength agent; applying the foam to a first surface of a base embryonic ply web, wherein the base embryonic ply web has a second surface opposite the first surface; providing an applied embryonic ply web having a first surface and an opposite second surface and contacting the first surface of the base embryonic ply web with the first surface of the applied embryonic ply web at an interface to form a combined ply web; and selectively applying vacuum pressure to the second surface of the base embryonic ply web to retain particles of the uncooked starch on or near the first surface of the base embryonic ply web and to draw molecules of the dry strength agent through the base embryonic ply web and/or to the first surface of the applied embryonic ply web to retain particles of the uncooked starch in the interface and to draw molecules of the dry strength agent through the applied embryonic ply web.

Other desirable features will become apparent from the following detailed description and the appended claims, taken in conjunction with the accompanying drawings and this background.

BRIEF DESCRIPTION OF THE DRAWINGS

A more complete understanding of the subject matter may be derived from the following detailed description taken in conjunction with the accompanying drawings, wherein like reference numerals denote like elements, and wherein.

Figure 5:
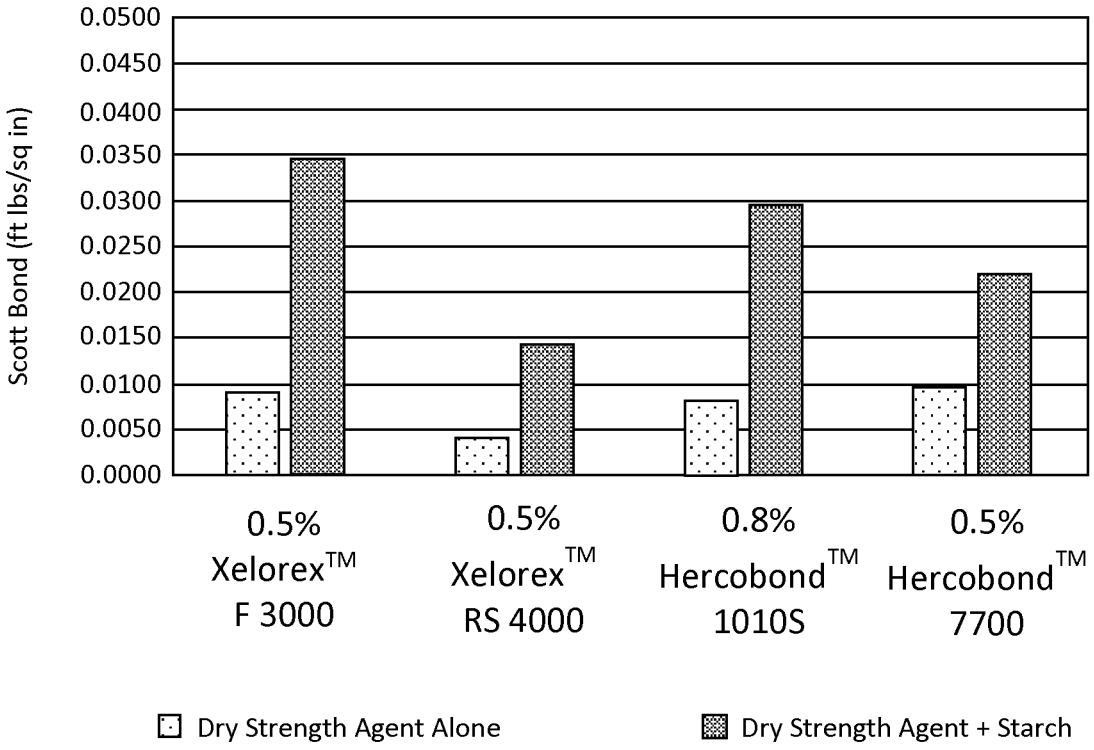
FIG. 5 is a graph illustrating the Scott Bond strength for comparative embodiments using only a synthetic dry strength agent and a synthetic dry strength agent plus uncooked starch, for four synthetic dry strength agents, for embodiments in accordance with embodiments herein.
Figure 7:
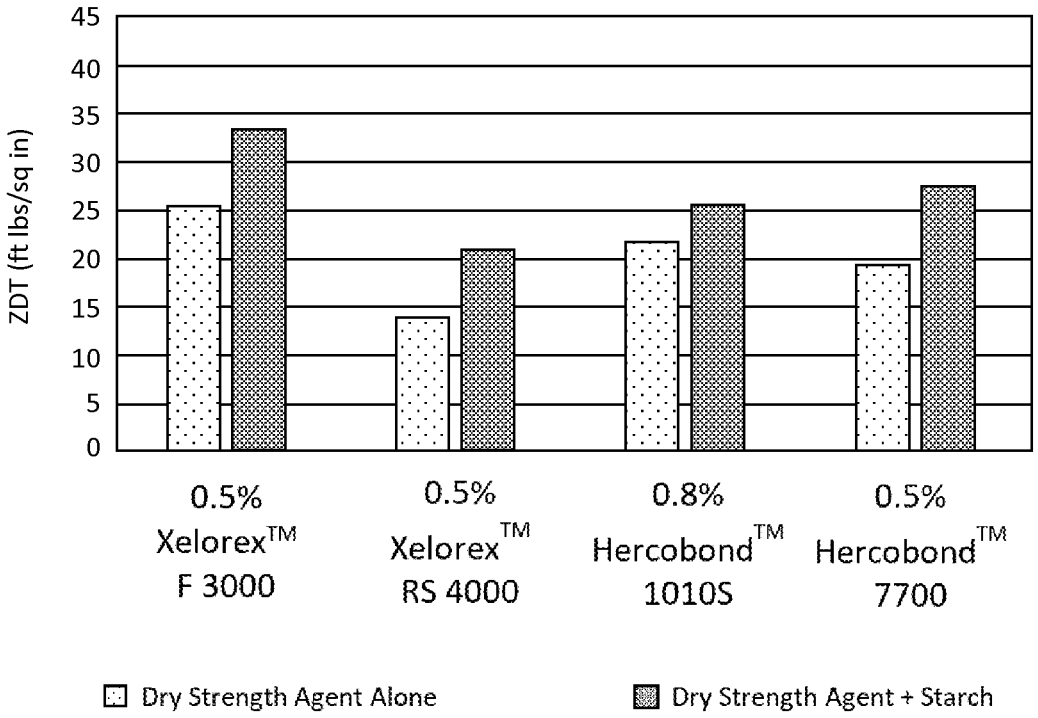
Figure 8:
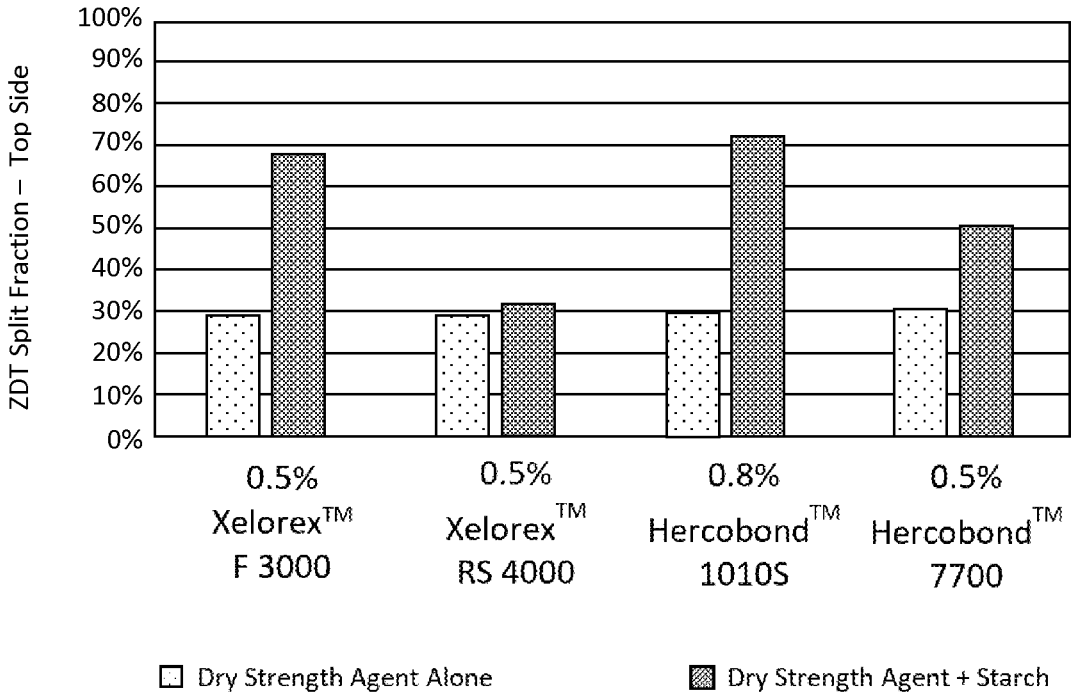

5 using only a synthetic dry strength agent and a dry strength agent plus uncooked starch, for four synthetic dry strength agents;

FIG. 7 is a graph illustrating the Z-Direction Tensile Strength (ZDT) for comparative embodiments using only a synthetic dry strength agent and a dry strength agent plus uncooked starch, for four synthetic dry strength agents, for embodiments in accordance with embodiments herein; and FIG. 8 is a graph illustrating Z-Direction Tensile Strength (ZDT) split location within the middle or base ply for comparative embodiments of FIG. 5 using only a synthetic dry strength agent and a dry strength agent plus uncooked starch, for four synthetic dry strength agents.

DETAILED DESCRIPTION

The following detailed description is merely illustrative in nature and is not intended to limit the embodiments of the subject matter or the application and uses of such embodiments. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the systems and methods defined by the claims. Furthermore, there is no intention to be bound by any expressed or implied theory presented in the preceding Technical Field, Background, Brief Summary, or the following Detailed Description. For the sake of brevity, conventional techniques and compositions may not be described in detail herein.

As used herein, "a," "an," or "the" means one or more unless otherwise specified. The term "or" can be conjunctive or disjunctive. Open terms such as "include," "including," "contain," "containing" and the like mean "comprising." The term "about" as used in connection with a numerical value throughout the specification and the claims denotes an interval of accuracy, familiar and acceptable to a person skilled in the art. In general, such interval of accuracy is ±ten percent. Thus, "about ten" means nine to eleven. All numbers in this description indicating amounts, ratios of materials, physical properties of materials, and/or use are to be understood as modified by the word "about," except as otherwise explicitly indicated. As used herein, the "%" described in the present disclosure refers to the weight percentage unless otherwise indicated.

Embodiments of the present disclosure relate to introducing uncooked starch and dry strength agents to paper substrates via a foam-assisted application technique.

Application of uncooked starch and dry strength agents to the wet web via foam application can be advantageous in that the chemistry is applied to the wet end, as with traditional approaches, but some of the typical disadvantages are avoided. Foam application can be expected to have better additive retention, thereby reducing or avoiding deposits, and the application to the wet web surface allows some benefits of the spray applications while still being able to penetrate into the web. Embodiments using foam application of uncooked starch and dry strength agents to paper substrates have advantages over the standard practices in terms of efficiency, cost, and targeted application.

As described herein, uncooked starch and dry strength agents are applied via foam to the surface of a ply. The foam is pulled into the web via vacuum, or negative pressure force, which can provide multiple advantages over traditional approaches. For example, the concentrations in the foam and application to the surface can be optimized to provide better retention in the web as compared to conventional wet-end applications. Further, foam is more easily controlled and managed than a spray application, and foam does not cause accumulation of sprayed component droplets on surfaces as overspray. Also, there is potential to apply higher viscosity chemistries as well as higher concentrations of chemistry in a foam as compared to typical limitations of spray application. Additionally, the application to the web surface allows for tunable penetration into the web and a controlled distribution from one surface as opposed to an even distribution throughout the Z-direction of the web.

Exemplary embodiments herein highlight the synergistic effects of combining uncooked starch and dry strength agents (DSA) to achieve strength properties greater than when uncooked starch or dry strength agents are used alone, i.e., not in combination with one another.

Exemplary embodiments herein introduce a natural, bio-based, or synthetic dry strength agent (hereafter, a strength agent or a dry strength agent) into a multi-ply paper product.

Embodiments herein achieve an improvement in paper strength properties and a change in the weak point of the paper product through a new application approach (foam-assisted additive addition of both uncooked starch and dry strength agents). By leveraging this process change with the combination of dry strength agents and uncooked starch, improvements in strength over that of the individual components are attained. Additionally, this application method allows tuning of the split location in the sheet which would be difficult using traditional, currently available approaches.

Figure 1:
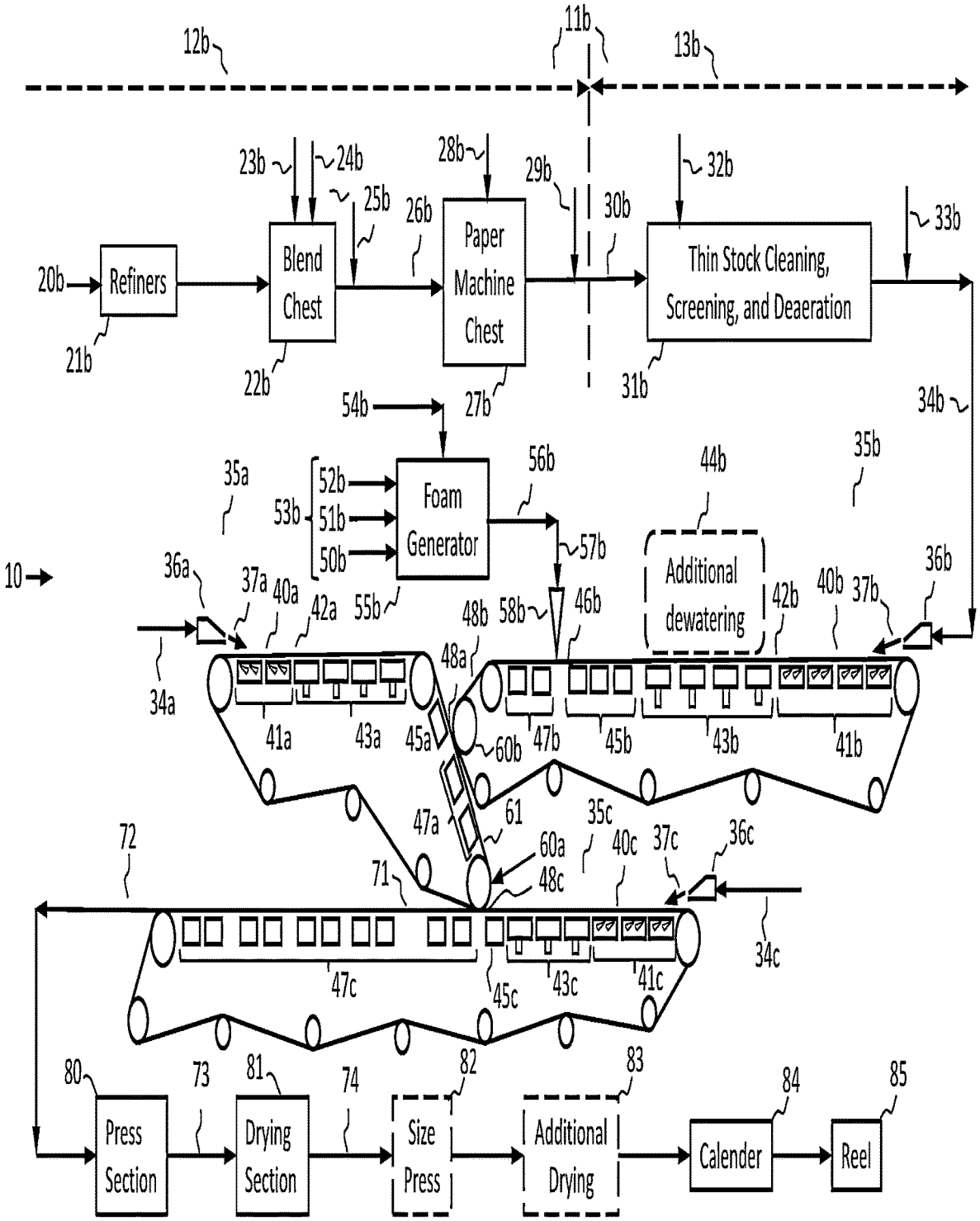
FIG. 1 is a schematic of a multi-ply papermaking apparatus in accordance with various embodiments.

A schematic of a device 10, a schematic for the formation of a three-ply sheet using the previously described "dry on dry" method, and for applying a foamed formulation to a wet embryonic web is shown in FIG. 1. The device 10 includes a middle ply stock preparation section 11*b* which includes a middle ply thick stock circuit 12*b* and a middle ply thin stock circuit 13*b*. In this figure, the flow of a middle ply component stock 20*b* is illustrated using solid arrows. In an embodiment, the middle ply thick stock section 12*b* comprises one or more middle ply refiners 21*b* configured to improve fiber-fiber bonding in the middle ply thick stock component 20*b* by making fibers of the middle ply thick stock component 20*b* more flexible and by increasing their surface area through mechanical action applied to the middle ply component thick stock 20*b* at a consistency of from about 2.0 to 5.0% dry solids. In an embodiment, subsequent to the refiners, the middle ply thick stock component 20*b* enters a middle ply blend chest 22*b*. In the middle ply blend chest 22*b*, the stock component 20*b* may optionally be blended with middle ply stock component or components 23*b* from other sources, for example, broke. Additionally, the stock component 20*b* may be blended with chemical additives 24*b* in the middle ply blend chest 22*b*. After exiting from the middle ply blend chest 22*b*, the middle ply stock components 20*b* and 23*b* may be diluted through the addition of water 25*b* in order to control the consistency of the middle ply stock components 20*b* and 23*b* to be within a pre-determined target range; the blended and consistency adjusted middle ply stock can now be called 26*b*. The middle ply stock 26*b* then enters a middle ply paper machine chest 27*b* where additional chemical additives 28*b* may be added. In an embodiment, as the stock exits from the middle ply paper machine chest 27*b*, the middle ply stock 26*b* is diluted with a large amount of water 29*b* to control the consistency of the middle ply stock 26*b* to be from about 0.5 to 1.0% dry solids as the middle ply stock 26*b* exits the middle ply thick stock circuit 12*b*. The middle ply stock 26*b*, with a consistency of from 0.5 to 1.0% dry solids, can now be called 30*b* as it enters the middle ply thin stock circuit 13*b*.

In an exemplary embodiment, within the middle ply thin stock circuit 13*b*, the middle ply stock 30*b* may pass through low consistency cleaning, screening, and deaeration devices. In exemplary embodiments, additional chemical additives 32*b* may be added to the stock 30*b* in any number of locations within the middle ply cleaning, screening, and deaeration area 31*b*, for example at location 32*b*, and also at location 33*b* in the approach flow piping 34*b* to the middle ply forming section 35*b*. The middle ply stock 30*b* can now be called 37*b* as it enters the mid ply forming section 35*b*. In exemplary embodiments, in the middle ply forming section 35*b*, a middle ply headbox 36*b* distributes the middle ply stock 37*b* onto a moving woven fabric (the middle ply "forming fabric") 40*b*. In exemplary embodiments, the middle ply forming fabric 40*b* transports the middle ply stock 37*b* over one or more boxes of hydrafoils 41*b*, which serve to drain water from the middle ply stock 37*b* and thereby increase the consistency of the stock 37*b* to form an embryonic middle ply web 42*b*. In exemplary embodiments, when the embryonic middle ply web 42*b* has a consistency of from 2 to 3% dry solids, the web 42*b* then passes over one or more low vacuum boxes 43*b*, which are configured to apply a "low" vacuum to the embryonic middle ply web 42*b* in order to remove additional water from the web. The embryonic middle ply web 42*b* may also be dewatered further by an optional additional dewatering unit 44*b* mounted above the middle ply forming fabric 40*b*. The embryonic middle ply web 42*b* be may subsequently pass over one or more "high" vacuum boxes 45*b*, where a higher vacuum, i.e., stronger negative pressure, force removes additional water until the web 42*b* has a consistency of from 6 to 12% dry solids. The wet middle ply web, no longer embryonic, is now referred to as 46*b*.

In an exemplary embodiment, uncooked starch 50*b*, one or more dry strength agents 51*b*, and a foaming agent 52*b* (if needed), collectively called the foaming formulation 53*b*, is mixed with a gas 54*b* (usually air) in a middle ply foam generator 55*b* to create a foam 56*b*. In an exemplary embodiment, after the incorporation of gas 54*b* into the foaming formulation 53*b*, the resultant middle ply foam 56*b* is conveyed via a pipe or a hose 57*b* to a middle ply foam distributor 58*b* where the middle ply foam 56*b* is applied onto the wet middle ply web 46*b*. In an exemplary embodiment, the foam 56*b* is applied between a high vacuum box 45*b* and a post-application high vacuum box 47*b*. The vacuum created by the high vacuum box 47*b* following the foam application draws the foam 56*b* into the wet middle ply web 46*b*. The foam coated and vacuum treated middle ply web, now called 48*b*, is also typically at a somewhat higher consistency, from 8 to 12%, due to the influence of vacuum from the high vacuum boxes 47*b*.

The above description of the middle ply production capabilities of device 10 (middle ply stock preparation system 11*b*, middle ply paper forming system 35*b*, and middle ply foam addition system 53*b*-58*b*). It acts in conjunction with a top ply former 35*a* and bottom ply former 35*c* (comparable to middle ply former 35*b*). The top ply forming section 35*c* and the back ply forming section are supported by corresponding top and back ply stock preparation systems (not shown in FIG. 1). The top ply wet web 48*a* produced by top ply former 35*a* is merged with the middle ply wet web 48*b* by combining roll 60*b*, which transfers the wet middle ply web to the top ply wet web on top ply forming fabric 40*a* between initial high vacuum box 45*a* and the final top ply high vacuum boxes 47*a*.

The wet top ply 48*a* and the wet middle ply 48*b*, called 61 when combined, is transferred to the wet back ply web 48*c* by combining roll 60*c*, which presses the combined wet top ply and middle ply web 61 to the wet back ply web 48*c* immediately following the back ply high vacuum box 45*c* and before back ply subsequent high vacuum boxes 47C on back ply former 35*c*. The web 71 is comprised of the combined wet top ply web 48*a*, the wet middle ply web 48*b*, and the wet back ply web 48*c*. The combined wet web 71 may be further dewatered by additional high vacuum boxes 47*c* on back ply former 35*c* to about 20 to 25% solids, and is now called 72.

Combined web 72 enters the pressing section 80, where press rolls press additional water from the wet web 72. The wet web 72 exits the pressing section with a consistency of about 40 to 55% dry solids and is then called web 73. Wet web 73 enters a drying section 81, where heated dryer cylinders heat the web 73 and evaporate additional water from the web 73. The heat from the dryers and the remaining moisture within the wet sheet swell the uncooked starch particles, which form a gel and adhere the top ply 48*a* to the middle ply 48*b* as the wet plies continue to dry. The wet web 73 is dried to from 6 to 10% consistency (90 to 94% dry) within the drying section and is now called dry sheet 74. After the drying section 81 the dry web 74 may go directly to the calendar 84 and reel 85, or it may be treated with a surface size in the optional size press 82; if so treated, it is then dried again with additional dryers 83. Following the drying section 81 or optionally size press 82 and additional drying 83, the sheet 74 may be treated with a calender 84 to improve surface smoothness and control sheet thickness, then the sheet may be reeled by a reel device 85.

Figure 2:
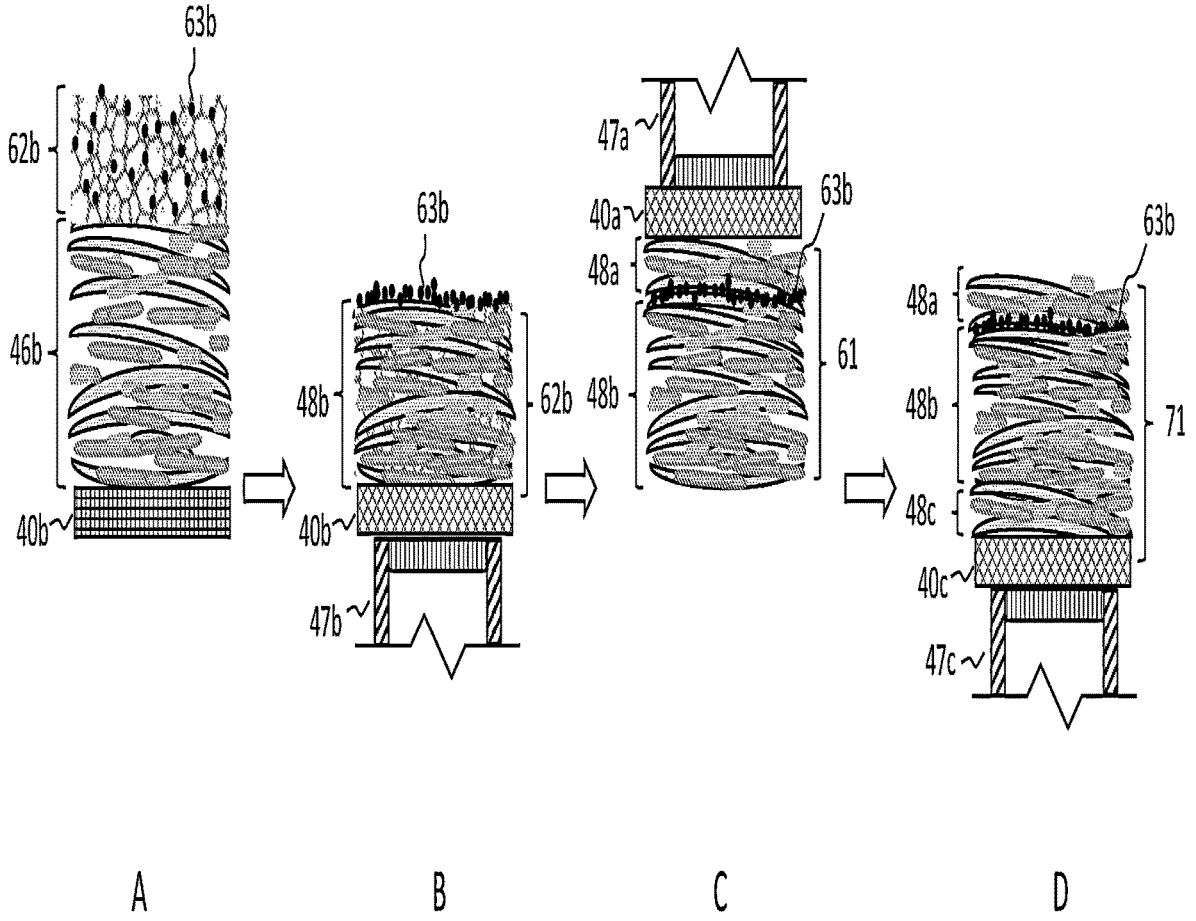
FIG. 2 is a schematic illustrating how a multi-ply web is compiled from separately formed plies in accordance with various embodiments.

It should be understood that the description of the middle ply stock preparation system 11*b* and middle ply former 35*b* which produces the wet middle ply web 48*b*, is also a good general description of the top ply and back ply stock preparation systems (not shown in FIG. 2). Further, the description of the middle ply forming section 35*b* is also a good general description of the top ply forming section 35*a* and the back ply forming section 35*c*, respectively. Each numbered item in each web forming system are correspondingly numbered, with the suffix "b" applied to the components of the middle ply forming system 35*b*, the suffix "a" applied to the correspondingly numbered components of the top ply system, and the suffix "c" applied to the correspondingly numbered components of the back ply forming system 35*c*. For example, top ply headbox 36*a* corresponds to middle ply headbox 36*b* and back ply headbox 36*c*, and so on.

It is also clearly understood by those skilled in the art that a number of variations in the details may differ from one manufacturing plant location to another, yet the same purpose is accomplished and hence such variations are contemplated as part of the system described and claimed herein. For example, middle ply stock preparation thick stock system 12*b* shows refiners acting on stock component 20*b*, but not on additional stock component or components 23*b*. In some cases, other stock components may be blended with stock component 20*b* before refiners 21*b* and co-refined with stock component 20*b*. There may be fewer or more foil boxes 41*b*, low vacuum boxes 43*b*, or high vacuum boxes 45*b* prior to the addition of foamed paper additives 56*b*. Additional dewatering step 44*b* for example is identified as optional. The foam distributor 58*b* may advantageously apply foam 56*b* at any accessible location after the first low vacuum box 43*b* and before the last high vacuum box 45*b*. In some embodiments, there may be only two plies and in other embodiments there may be three or more plies. Foam may be advantageously applied between any two adjacent plies to enhance ply bonding and other Z-direction strength properties. Size press 82 combined with additional drying 83 are likewise shown as optional—they may be present in some cases and absent in other cases, within the scope of the system described herein. Many other similar variations may be within the scope of the system described herein.

It has been surprisingly observed that the application of uncooked starch and dry strength agents through a foam-assisted addition technique results in an improvement (or, in some scenarios, at least equivalent performance) in bonding-related strength properties of multi-ply paper products as compared to multi-ply paper products where dry strength agents are added through wet-end addition, and uncooked starch is added via a spray shower. Previously, foaming agents were known to reduce paper strength properties due to the foaming agents disrupting bonding between pulp fibers. However, when dry strength agents are added with the foam, the negative impact of the foaming agents may be reduced, or the bonding strength may be improved significantly.

Further, adjustment of the process variables (amount of wet foam coating per unit of sheet area, time and strength of vacuum application before and after the addition of foamed additives, ply thickness, ply % dry solids at the time of foamed additives application, and many other variables) can allow the distribution of the dry strength agent to be altered. This allows a more even distribution of dry strength agent within the sheet, or a higher concentration of dry strength agent closer to the surface where the foam was applied, to be chosen. Without being bound by theory, the dry strength agent is believed to strengthen the ply overall, and in particular, the bonding strength in the portion of the web closest to the foamed additives application surface, while the uncooked starch, upon gelatinization in the dryer section, improves the ply bonding (the bonding between two adjacent plies). The bonding strength within the top ply may be less important as it is typically produced from well refined kraft fibers, which usually bond relatively well. The bonding within the middle ply is often lower, due to the use of lower bonding potential and high bulk fibers like bleached chemi-thermomechanical pulp (BCTMP) in the middle ply. The bonding within the back ply and the ply bond between the middle ply and the back ply are often less of an issue since the top ply is usually the printed surface. Exceptions may occur, especially if both sides are to be printed.

By strengthening the bonding within the middle ply with dry strength agents and by strengthening the ply bond between the top ply and the middle ply with uncooked starch, a considerably stronger internal bonding strength can be obtained for the overall multi-ply sheet. The process described herein allows this to be accomplished with relatively good chemical efficiency by improving the strength selectively where it most needs to be improved.

Addition of uncooked starch in the middle ply wet end (machine chest 27*b* addition or thin stock cleaning, screening, and deaeration system addition 31*b*) does not make sense, because the uncooked starch would be distributed throughout the middle ply web, and so would not be effective in improving ply bonding.

In an exemplary embodiment, shown pictorially in FIG. 2A, a layer of foamed additives 62*b*, i.e., the uncooked starch 50*b*, dry strength agent 51*b*, foaming agent 52*b* (if needed) and gas 54*b* formed into a foam 56*b*, may be applied to the wet middle ply web 46*b*. As the wet middle ply web 46*b*, which is being carried by middle ply forming fabric 40*b*, passes from vacuum boxes 45*b* to 47*b*, foam layer 62*b* is applied. Water is removed from the wet middle ply web 46*b* and particles of the uncooked starch 63*b* are drawn against the first surface of, and retained on the first surface of the wet middle ply web 46*b*, while molecules of the dry strength agent 51*b*, foaming agent 52*b* (if needed) and gas 54*b* (in the form of bubbles) are drawn into or through the wet middle ply web 46*b* and retained within the web by a combination of electrostatic and physical means, by the action of vacuum box 47*b*, as shown in FIG. 2B. The actual distribution of the dry strength molecules is dependent on the factors previously recited, but under the action of the middle ply high vacuum box or boxes 47*b*, all or most of the dry strength molecules from 56*b* are expected to be within the wet middle ply web. In addition, the wet middle ply web may be reduced in thickness slightly by the removal of some water by the middle ply vacuum box or boxes 47*b*. The uncooked starch particles 63*b* from the foam layer 62*b* remain on the surface of the wet middle ply web, which is now called 48*b*.

In the same exemplary embodiment, the wet top ply 48*a* which is being carried by top ply forming fabric 40*a*, is applied to the first surface of the wet middle ply 48*b* by the pressing action of the combining roll 60*b* (not shown in FIG. 2*c*), before treatment with vacuum box 47*a* as shown in FIG. 2C. Since the uncooked starch particles 63*b* are on or near the first or foam application surface of the wet middle ply web 48*b*, after application of the top ply 48*a*, the uncooked starch particles 63*b* are between the wet top ply 48*a* and the wet middle ply 48*b*. These uncooked starch particles 63*b* are thus ideally positioned to adhere the top ply to the middle ply when the uncooked starch particles 63*b* absorb water and gel as they are heated in the drying section 81. Additional water may also be removed by top ply high vacuum box or boxes 47*a* as the combined web 48*b* and 48*a* passes over the top ply high vacuum box or boxes 47*a*.

In the same exemplary embodiment, the wet back ply 48*c* is added to the opposite side (the forming fabric side) of wet middle ply 48*b* at the combining roll 60*a*, creating a three-ply structured sheet 71 as shown in FIG. 1 and FIG. 2D. The combined sheet 71 is comprised of top ply 48*a*, middle ply 48*b*, and back ply 48*c*. The uncooked starch particles 63*b* are trapped in the ply bond zone between top ply 48*a* and middle ply 48*b*, and the other components of the foaming formulation 53*b* are mostly contained within the middle ply 48*b*. The vacuum from the top ply high vacuum box or boxes 47*a* following combining roll 60*a* may remove additional water and further compacts and consolidates the combined sheet 71 to 20 to 25% solids and may also draw some molecules of wet strength agent 51*b* back toward top ply 48*a*.

It is understood that the system described herein is not limited to the exact configuration as shown in FIG. 1. For example, foamed additives corresponding to 56*b* applied with an applicator corresponding to 58*b* can be added to the top ply web 48*a* immediately prior to high vacuum suction box 45*a*. In this embodiment, high vacuum suction boxes 45*a* and 47*a* would draw the dry strength molecules into the wet top ply 48*a*, but the uncooked starch particles would remain in the ply bond area between the wet top ply 48*a* and the wet middle ply 48*b*. Likewise foamed additives corresponding to 56*b* applied with a foam distributor corresponding to 58*b* can be applied to the back ply 48*c* immediately prior to high vacuum box 45*c*. High vacuum boxes 45*c* and 47*c* would draw the dry strength molecules into the back ply 48*c* while the uncooked starch particles corresponding to 62*b* would remain in the ply bond area between bottom ply 48*c* and middle ply 48*b*. The choice of where to apply the foam containing the dry strength agent and the uncooked starch should be made based on the forming section configuration, which ply needs internal bonding improvement, and which ply bond joint needs to be strengthened.

Foaming Agent

As used herein, the term "foaming agent" defines a substance which lowers the surface tension of the liquid medium into which it is dissolved, and/or the interfacial tension with other phases, to thereby be absorbed at the liquid/vapor interface (or other such interfaces). Foaming agents are generally used to generate or stabilize foams.

Foaming agents generally reduce bonding-related paper strength parameters by disrupting bonding between pulp fibers. It was observed that the use of a foaming formulation having about the minimum amount of foaming agent sufficient to produce a foam minimizes the reduction of bonding-related paper strength parameters in this manner. In particular, it was observed that the dosage of foaming agent required to effectively disperse a certain amount of uncooked starch and dry strength agent in a foam having gas bubbles with a mean maximum dimension or diameter of from 50 to 150 micrometers and a gas content of from 70% to 90% may vary in relation to the type and dosage of the uncooked starch and dry strength agent, and the foaming formulation temperature and pH. This amount of foaming agent is defined herein as the "minimally sufficient" foaming agent dose, and is desirable to reduce the negative effects many foaming agents have on fiber bonding, and also to reduce cost and reduce potential subsequent foaming problems elsewhere in the paper machine white water circuit.

It has been determined that not all types of foaming agents are satisfactory in all circumstances. Some foaming agents, such as the anionic foaming agent sodium dodecyl sulfate (SDS), tends to result in a decrease in bonding-related strength parameters of the final paper product. SDS is conventionally known as a preferred foaming agent because of its low cost and the small dose normally required to achieve a target gas content in the foam. However, it has been discovered that the anionic charge of SDS may interfere with certain dry strength agents that have a cationic functional group and result in the formation of a gel-like association (i.e., coacervate). This association may create foam handling problems and inhibit the migration of the foamed strength agent into the embryonic web. Even under ideal circumstances (with no charge interference occurring between SDS and a cationic-group-containing dry strength agent) SDS still acts to reduce strength due to bonding interference. It has been established in the development of the system described herein that certain other types of foaming agents were unable to produce a foam of the targeted gas content range, unless cost-prohibitive concentrations of the foaming agent were used.

An investigation was performed into which foaming agents produced foams with the desired qualities of gas content and bubble size range for the foam-assisted application of certain strength agents. It was observed that improved physical parameters in the investigative paper sheet samples were obtained when the foam applied to the samples had a gas content of from 40% to 95%, for example from 70% to 90%. In an exemplary embodiment, the gas is air. In various exemplary embodiments, the foams are formed by shearing a foaming formulation in the presence of sufficient gas, or by injecting gas into the foaming solution, or by injecting the foaming solution into a gas flow.

It was also observed that improved physical properties of the paper sheet samples were obtained when the foaming formulation included one or more foaming agents in an amount of from 0.001% to 10% by weight, based on a total weight of the foaming formulation, for example from 0.01% to 1% by weight, based on a total weight of the foaming formulation. Still further, it was observed that improved physical properties of the paper sheet samples resulted when the amount of foaming agent was minimized to only about that sufficient to produce a foam with a target gas content and bubble size.

Generally, the desired foaming agent concentration results in a foam with about all of the gas bubbles within the preferred diameter range of from 50 to 150 micrometers. Adding a foaming agent in excess of about the minimally sufficient dose of foaming agent required to produce a foam with the targeted gas content increases the likelihood of loss of bonding-related strength properties and therefore the increase in the magnitude of the strength parameter loss. Use of excessive foaming agent beyond that required to produce a foam, for example using an excessive amount of foaming agent of more than 10% by weight of the foaming solution, also increases the total cost of the treatment.

It was observed that the preferred foaming agents for use in foam-assisted application of uncooked starch with dry strength agents having a cationic functional group were foaming agents selected from subsets of the groups of nonionic, zwitterionic, amphoteric or cationic types of foaming agents, or combinations of the same type or more than one type of these foaming agents. In particular, preferred foaming agents are selected from the group of nonionic foaming agents, zwitterionic foaming agents, amphoteric foaming agents, and combinations thereof.

Without being bound by theory, the improved results in strength parameters obtained by the nonionic and zwitterionic or amphoteric foaming agents were believed to be due to the lack of electrostatic interaction between these types of foaming agents and the pulp fibers and the cationic strength agents. In particular, improved results were obtained through the use of nonionic foaming agents selected from the group of ethoxylates, alkoxylated fatty acids, polyethoxy esters, glycerol esters, polyol esters, hexitol esters, fatty alcohols, alkoxylated alcohols, alkoxylated alkyl phenols, alkoxylated glycerin, alkoxylated amines, alkoxylated diamines, fatty amide, fatty acid alkylol amide, alkoxylated amides, alkoxylated imidazoles, fatty amide oxides, alkanol amines, alkanolamides, polyethylene glycol, ethylene and propylene oxide, EO/PO copolymers and their derivatives, polyester, alkyl saccharides, alkyl, polysaccharide, alkyl glucosides, alkyl polygulocosides, alkyl glycol ether, polyoxyalkylene alkyl ethers, polyvinyl alcohols, alkyl polysaccharides, their derivatives and combinations thereof.

Improved results in strength parameters were also obtained through the use of zwitterionic or amphoteric foaming agents selected from the group of lauryl dimethylamine oxide, cocoamphoacetate, cocoamphodiacetate, cocoamphodiproprionate, cocamidopropyl betaine, alkyl betaine, alkyl amido betaine, hydroxysulfo betaine, cocamidopropyl hydroxysultain, alkyliminodipropionate, amine oxide, amino acid derivatives, alkyl dimethylamine oxide and nonionic surfactants such as alkyl polyglucosides and poly alkyl polysaccharide and combinations thereof.

It was observed that anionic foaming agents may also produce improved results in strength parameters when combined with strength agents having a cationic functional group that have a relatively low cationic charge, for example a molar concentration of cationic functional groups of below around 16%. Preferred anionic foaming agents are foaming agents selected from the group of alkyl sulfates and their derivatives, alkyl sulfonates and sulfonic acid derivatives, alkali metal sulforicinates, sulfonated glyceryl esters of fatty acids, sulfonated alcohol esters, fatty acid salts and derivatives, alkyl amino acids, amides of amino sulfonic acids, sulfonated fatty acids nitriles, ether sulfates, sulfuric esters, alkylnapthylsulfonic acid and salts, sulfosuccinate and sulfosuccinic acid derivatives, phosphates and phosphonic acid derivatives, alkyl ether phosphate and phosphate esters, and combinations thereof.

It was observed that cationic foaming agents may also produce improved results in strength parameters when combined with strength agents having a cationic functional group that have a relatively low cationic charge, for example a molar concentration of cationic functional groups of below around 16%. Preferred cationic foaming agents are foaming agents selected from the group of alkyl amine and amide and their derivatives, alkyl ammoniums, alkoxylated amine and amide and their derivatives, fatty amine and fatty amide and their derivatives, quaternary ammoniums, alkyl quaternary ammoniums and their derivatives and their salts, imidazolines derivatives, carbyl ammonium salts, carbyl phosphonium salts, polymers and copolymers of structures described above, and combinations thereof.

Combinations of the above-described foaming agents are also disclosed herein. Combining certain different types of foaming agents allows for the combination of different benefits. For example, anionic foaming agents are generally cheaper than other foaming agents and are generally effective at producing foam, but may not be as effective at improving the bonding-related strength properties of paper. Nonionic, zwitterionic or amphoteric foaming agents are generally more costly than anionic foaming agents, but are generally more effective in conjunction with strength agents having a cationic functional group at improving strength properties. As such, the combination of an anionic and a nonionic, zwitterionic, and/or amphoteric foaming agent may provide the dual benefits of being cost-effective whilst also improving strength properties of the paper sheet, or at least provide a compromise between these two properties. Foaming agents may also be combined to take advantage of the high foaming capabilities of one type of foaming agent and the better bonding improvement properties of another type of foaming agent. With certain combinations, there exists a synergistic improvement in bonding-related strength properties with the use of certain foaming agents and certain strength agents having a cationic functional group, for example cationic or amphoteric strength agents. Anionic or non-ionic strength agents may also exhibit such synergies with certain foaming agents or combinations thereof.

In an exemplary embodiment, the foaming agent is poly (vinyl alcohol), also called polyvinylalcohol, PVA, PVOH, or PVAl and its derivatives. The combination of a PVOH foaming agent and a strength agent having a cationic functional group was observed to provide improved strength properties on the samples as compared to those resulting from wet-end addition of the same cationic strength agent. Polyvinyl alcohol foaming agents with higher molecular weight, a lower degree of hydrolysis and the absence of defoamers typically provided good strength properties through the foam-assisted application of strength agents. In an exemplary embodiment, the polyvinyl alcohol has a degree of hydrolysis of between around 70% and 99.9%, for example between around 86 and around 90%. In an exemplary embodiment, the polyvinyl alcohol foaming agent has a number average molecular weight of from 5000 to 400,000, resulting in a viscosity of from 3 to 75 cP at 4% solids and 20° C. In an exemplary embodiment, the polyvinyl alcohol foaming agent has a number average molecular weight of from 70,000 to 100,000, resulting in a viscosity of from 45 to 55 cP at 4% solids and 20° C. It is also noted that polyvinyl alcohol-based foaming agents advantageously do not weaken paper-strength parameters by disrupting bonding between pulp fibers of the web. A combination of a nonionic, zwitterionic, or amphoteric foaming agent with a polyvinyl alcohol foaming agent (or its derivatives) at other molecular weights and degrees of hydrolysis also provided good foam qualities and good strength improvements in conjunction with cationic strength agents.

It was also observed that improved physical parameters in the samples were obtained when the foaming agents used had a hydrophilic-lipophilic balance (HLB) of above around 8. A HLB balance of above around 8 promotes the ability to produce foams in aqueous compositions.

Uncooked Starch

Uncooked starch is used herein to provide the manufactured paper product with improved ply bonding. Uncooked starch is introduced to the surface of a wet web before the wet web is contacted with another wet web to form an interface between the plies. The purpose of the uncooked starch is to help with ply to ply adhesion, also called ply bonding. The uncooked starch will gelatinize under heat in the dryer section in the presence of water. This aids in adhesion between the different plies. The purpose of the uncooked starch is not to necessarily improve the strength of either ply on its own, but rather to improve the bond between plies.

In exemplary embodiments, the uncooked starch is provided in the form of particles, and the particles have a mean maximum dimension of from 5 to 50 microns.

Starch is a natural polymer derived from corn, wheat, rice, tapioca, potatoes, cassava, or other plants, consists of straight chain molecules (amylase) and branched molecules (amylopectin). Natural starch granules derived from corn may be from 5 to 25 μm, while those derived from potatoes may be from 15 to 100 μm and those derived from wheat may be from 5 to 25 μm diameter. When heated in water, the granules swell, gel, burst, and dissolve as individual molecules, with a characteristic molecular weight. The temperature at which they gel also depends on the source of the starch granules. Corn starch granules gel at from 72 to 75° C., while potato starch granules gel at from 62 to 65° C. and wheat starch granules gel at from 62 to 80° C. Native (unmodified) starch solutions typically contribute more to sheet strength than modified (degraded) starch, but the native starch solution may be difficult to handle due to higher viscosity. Starch may be degraded selectively by oxidation with sodium hypochlorite or other oxidants. The degree of oxidation impacts the starch solution viscosity as well as the potential bonding improvement contribution of the starch. Starch may also be modified by chemical derivatization (ethylated starch is the most common derivatization). Commercial starch products may contain blends of starch from different plant sources. Starch sales contracts sometimes allow substitution of one plant source for another as the market price or availability fluctuates.

In its uncooked state, the starch has limited or no adhesive qualities. However, when a starch slurry is heated sufficiently the starch granules will absorb the liquid of suspension available and swell, causing gelation of the starch granules. In this state the starch has superior adhesion abilities and will form a bond between many substrates, including paper.

Uncooked starch has been applied to the surface of multi-ply paperboard plies in the forming section for the purpose of improving ply bonding. Current practice is to apply the uncooked starch via spray nozzles mounted on a spray bar across the forming section, over the wet ply. This method produces improved ply bonding, but the overspray from the spray nozzles creates worker inhalation risks, and accumulates on exposed surfaces. Oversprayed starch promotes slippery conditions and biological growth, which can create corrosion as well as slippery walking conditions. In addition, some locations experience nozzle plugging depending on the starch grain size and the spray nozzle dimensions.

Dry Strength Agent

As used herein, "dry strength agents" provide for increased strength properties of the final paper product, measured when the paper is conditioned to equilibrium at 23° C.+/−1° C. and 50%+/−2% relative humidity. Dry strength agents typically function by increasing the total bonded area of fiber-fiber bonds, not by making the individual fibers of the web stronger. Increased bonded area of fibers, and the subsequent increased bonding-related sheet strength properties, can be achieved through other techniques as well. For example, increased fiber refining, sheet wet pressing, and improved formation may be used to increase the bonded area of fibers. In certain cases, the improvement in fiber bonding-related paper strength properties achieved through the foam-assisted application of dry strength agents was shown to be larger than the wet-end addition of the same strength agents. In particular, one advantage associated with the foam-assisted application of dry strength agents is that a higher concentration of dry strength agent can be introduced into the wet formed sheet, whereas the practical dosage range of dry strength agent limits the concentration of wet-end additives in the very low consistency environment of traditional wet-end addition. In traditional wet-end addition, the limitation of dosage of dry strength agent led to bonding-related sheet strength property "plateauing" of the dose-response curve at relatively low dosages, whereas the foam-assisted addition of dry strength agent led to a continued dosage response, where an increase in the concentration of dry strength agent applied to the wet sheet resulted in an increase in the strength properties of the resultant paper product, even at much higher than normal dose applications.

In an exemplary embodiment, the dry strength agent is a synthetic dry strength agent comprising a cationic functional group, for example a cationic strength agent or an amphoteric strength agent. As explained in more detail below, is noted that synthetic strength agents having a cationic functional group improve the bonding related strength properties of the final paper sheet.

In an exemplary embodiment, the foam-assisted application is performed using a foaming formulation including at least one dry strength agent in an amount of from 0.01% to 50% by weight, based on a total weight of the foaming formulation, for example from 0.1% to 10% by weight, based on a total weight of the foaming formulation.

Without being bound by theory, it may be that the improvement in paper bonding related strength properties achieved through the foam-assisted application of certain strength agents as compared to wet-end addition of the same agents is that there is a better retention of the agents with foam-assisted application. In particular, since the foamed application of agents is performed when the sheet has a higher concentration of fibers to water (with the water content typically being from 70 to 90%) as compared to the wet-end addition of strength agents to the pulp in the stock preparation sections (where the water content is typically from 95 to 99% or more), less strength agent loss occurs when the pulp is passed through subsequent water removal sections. In exemplary embodiments, the step of applying foam to the wet formed embryonic web is performed when the wet formed embryonic web has a pulp fiber consistency of from 5% to 45%, for example from 5% to 30%.

Without being bound by theory, it is believed that the improvement in paper strength parameters resulting from the foam-assisted application of certain strength agents as compared to the wet-end addition of the same agents is because contaminating substances/contaminants that interfere with the additive adsorption of the strength agents onto the fibers may be present in greater quantities in the stock preparation section, particularly in the thin stock section, as will be explained in more detail below.

Without being bound by theory, it is believed that the improvement in paper parameters resulting from the foam-assisted application of certain strength agents as compared to the wet-end addition of the same agents is that, because the strength agents are incorporated into the sheet at least in part by a physical means instead of only by a surface charge means, a lack of remaining available charged sites in the forming web does not limit the amount of strength agent that can be incorporated into the sheet. A lack of remaining available charged bonding sites in the forming web, such as a lack of remaining available anionic charged sites, may occur when additives are introduced by wet-end addition, especially when large amounts of additives are introduced in this manner. Alternatively or additionally, and without being bound by theory, the improved strength could be due to the unique DSA distribution in the sheet provided by embodiments herein. Rather than uniform distribution throughout, it is believed that the foam application concentrates the DSA distribution in the sheet in targeted areas.

In exemplary embodiments, the dry strength agent comprises synthetic dry strength agent(s). It is noted that, as used herein, the term "synthetic" strength agent excludes natural strength agents. In exemplary embodiments, the synthetic dry strength agents comprise synthetic strength agents having a cationic functional group. In other embodiments, the synthetic dry strength agents comprise synthetic strength agents having an anionic functional group. In yet other embodiment, the synthetic dry strength agents comprise synthetic strength agents having an amphoteric functional group In an exemplary embodiment, the synthetic strength agent comprises a graft copolymer of a vinyl monomer and functionalized vinyl amine, a vinyl amine containing polymer, or an acrylamide containing polymer. In an exemplary embodiment, the at least one synthetic dry strength agent having a cationic functional group is selected from the group of: acrylamide-diallyldimethylammonium chloride copolymers; glyoxylated acrylamide-diallyldimethylammonium chloride copolymers; vinylamine containing polymers and copolymers; polyamidoamine-epichlorohydrin polymers; glyoxylated acrylamide polymers; polyethyleneimine; acryloyloxyethyltrimethyl ammonium chloride. An exemplary synthetic strength agent including a graft copolymer of a vinyl monomer and a functionalized vinyl amine.

Additionally or alternatively, in an exemplary embodiment, the at least one synthetic strength agent having a cationic functional group is selected from the group of DADMAC-acrylamide copolymers, with or without subsequent glyoxylation; Polymers and copolymers of acrylamide with cationic groups comprising AETAC, AETAS, METAC, METAS, APTAC, MAPTAC, DMAEMA, or combinations thereof, with or without subsequent glyoxylation; Vinylamine containing polymers and copolymers; PAE polymers;

Polyethyleneimines; Poly-DADMACs; Polyamines; and Polymers based upon dimethylaminomethyl-substituted acrylamide, wherein: DADMAC is diallyldimethylammonium chloride; DMAEMA is dimethylaminoethylmethacrylate; AETAC is acryloyloxyethyltrimethyl chloride; AETAS is acryloyloxyethyltrimethyl sulfate; METAC is methacryloyloxyethyltrimethyl chloride; METAS is methacryloyloxyethyltrimethyl sulfate; APTAC is acryloylamidopropyltrimethylammonium chloride; MAPTAC is acryloylamidopropyltrimethylammonium chloride; and PAE is polyamidoamine-epichlorohydrin polymers.

It was also observed that synthetic dry strength agents having a cationic functional group and also containing primary amine functional units, in the form of polyvinylamine polymer units, were effective in improving strength parameters as compared to synthetic strength agents which did not contain primary amine functional units. In an exemplary embodiment, the synthetic strength agent having a cationic functional group included in the foaming formulation has a primary amine functionality of from 1 to 100%.

In another embodiment, strength agents based on natural materials are used as the dry strength agent in the foaming formulation. Strength aids based on natural materials include cooked starch, guar, chitosan, microfibrillated cellulose (MFC), and many other materials known to those skilled in the arts. Foam application offers unique opportunities for application of MFC, which is difficult to apply via spraying due to the potential to clog the nozzles, and often must be diluted to very low solids content for conventional handling and application.

In yet another embodiment, bio-based strength agents composed of polymers synthesized from bio-based versions of fossil-based materials, to produce more sustainable versions of known synthetic strength agents.

Foam-Assisted Application

In an exemplary embodiment, the foam-assisted application of uncooked starch and dry strength agent occurs with the foam having an air content of from 40% to 95%, for example from 70% to 90%, based on a total volume of the foam. The foam may be formed by injecting gas into a foaming formulation, by shearing a foaming formulation in the presence of sufficient gas, by injecting a foaming formulation into a gas flow, or by other suitable means.

In an exemplary embodiment, the foam is produced with a foam density of from 50 to 300 g/L, for example, from 100 to 300 g/L, such as from 150 to 300 g/L.

In an exemplary embodiment, when applying the foam to a wet ply web, the foam is applied at a foam coverage level of from 30 to 300 wet g/m$^2$, such as less than 200 wet g/m$^2$, for example, from 60 to 150 wet g/m$^2$.

In an exemplary embodiment, when applying the foam to the ply web, the foam is applied such that a dosage of the dry mass of uncooked starch to the wet ply web area is from 0.1 to 4 g/m$^2$, for example, at least 0.75 g/m$^2$, or at least 1 g/m$^2$, and no more than about 3 g/m$^2$, or no more than about 2.5 g/m$^2$.

In an exemplary embodiment, when applying the foam to the ply web, the foam is applied such that a dosage of the dry strength agent or agents to the wet ply web is at least 0.075% actives, such as at least 0.2% actives, and no more than 1.2% actives, such as no more than 0.8 actives, all based on the ply dry weight.

In an exemplary embodiment, when applying the foam to the ply web, the ply web is from 5 to 20% solids, for example, 5 to 15% solids or 8 to 15% solids.

Without being limited by theory, it is noted that when a small batch of foaming formulation is foamed by incorporating air into the liquid by means of a high speed homogenizer in an open top container, the amount of gas that is dispersed into fine bubbles having a maximum dimension, such as diameter, of from 10 to 300 micrometers (μm) is limited by the characteristics and concentration of the foaming agent and its interaction with the uncooked starch particles and dry strength agent molecules. As the air content increases, the foam becomes more viscous, and at some air content, it cannot effectively fall back into the vortex created by the homogenizer. For a given type and concentration of the foaming agent, a maximum gas content is typically achieved within less than a minute. Further homogenizing cannot entrain more gas as 10 to 300 micrometer diameter bubbles, as any additional gas drawn into the vortex is dispersed as much larger bubbles having a maximum dimension of from 2 to 20 millimeter (mm) diameter. Bubbles of this size quickly coalesce and float to the top of the foam, where they typically burst, and the gas exits the foam. The actual air content achieved at equilibrium (after from 30 to 60 seconds of homogenization) varies with the amount and type of dry strength additives and/or starch incorporated in the foaming formulation.

Without being limited by theory, it is noted that a commercially available foam generator can be used to produce suitable foam for foam assisted additive addition at pilot scale or commercial scale. Suitable commercially available foam generators sometimes produce foam by high shear caused by close clearance in a rotary device, by an oscillating device, by air induction, or by other suitable means. Most are pressurized, which is convenient for feeding the foam to a foam distributor over the ply forming device. When excess gas is added into a pressurized foam generator, beyond what the foam generator can disperse as acceptable quality foam (10 to 300 μm bubbles), the excess gas is discharged (with the foam) as very large 2 to 20 mm diameter bubbles, dispersed within the foam. Bubbles of 2 to 20 mm diameter are much larger in diameter than the typical thickness of the wet ply web or the foam layer. Since uncooked starch particles and dry strength agent are only found in the liquid film and interstice area of the bubbles in the foam, very large diameter bubbles cannot deliver the uncooked starch particles and dry strength agent to the fiber crossing area if a large area of the sheet has only the film over a single bubble applied to the sheet. Bubbles smaller than the foam layer thickness or the wet web thickness are preferred for a more even distribution of uncooked starch and dry strength agent. Bubbles of from 20 to 300 μm diameter are preferred, especially bubbles of from 50 to 150 μm diameter, for this application, because bubbles of this size can carry the uncooked starch onto the wet ply web and dry strength agent into the wet ply web without disruption of the web and can therefore more efficiently distribute the uncooked starch and strength agent. A foam containing bubbles of from 50 to 150 μm diameter and from 70 to 80% air is convenient because it can be poured readily from an open top container. A foam containing up to from 90 to 95% air can be conveyed by pressure through a hose to and out of a foam distributor can be used to apply the foam to the ply web. Most foam generators cannot reliably produce acceptable quality foam for the described purpose with more than about 90% air.

EXAMPLES

Two ply handsheets, intended to model the top and middle ply of a three-ply paperboard sheet, were made with a Noble & Wood Handsheet Mold. A middle ply sheet of approximately 120 g/m$^2$ basis weight of bleached chemithermomechanical pulp (BCTMP) and mill supplied broke was prepared in the mold with standard wet-end additions of a sizing agent, a cooked starch, and a retention aid. The wet sheet was removed from the deckle and placed on the vacuum plate of a Gardco drawdown device attached to a vacuum pump. Exposed areas of the vacuum plate were covered with impermeable material to avoid loss of vacuum force due to air leakage around the handsheet. An initial vacuum was applied to remove water and consolidate the sheet. A foaming formulation was prepared by combining a foaming agent, a synthetic dry strength agent, and uncooked starch (when used) with water. The air was incorporated into the foaming formulation with a handheld homogenizer at atmospheric conditions, foams generated in this process are assumed to have approximately 70% air content. The foam was then poured onto the drawdown equipment adjacent to the sheet and the coating blade was used to distribute a uniform coating of foamed additives on the surface of the sheet. Foam addition levels are noted in the experiments below. A vacuum force was applied to draw the applied foamed additives onto the wet middle ply sheet surface (uncooked starch particles) or into the sheet (synthetic dry strength agent). A top ply sheet was then prepared in the Noble & Wood Handsheet Mold at approximately 40 g/m$^2$ final basis weight, from refined kraft pulp. The middle ply sheet with the foamed additives drawn into it was placed on a press felt, with the foam application side facing up. The top ply sheet was taken from the deckle of the Noble & Wood Handsheet Mold and placed face down onto the middle ply sheet, against the middle ply surface which the foam was previously applied to. Another press felt was applied over the combined sheet and the sheet was pressed and dried in the usual way.

Testing of exemplary embodiments was carried out with two ply handsheets produced as described above, Data was collected which showed improved strength performance when the two chemistries, i.e., uncooked starch and synthetic dry strength agents, are applied in combination versus a single chemistry alone, i.e., only uncooked starch or only synthetic dry strength agent. Without wishing to be bound by theory, it is believed that the uncooked starch will remain at or near the interface providing strength between the two plies whereas the synthetic dry strength agent is able to penetrate into the sheet and provide strength to the internals of the individual plies. This combined approach strengthens the sheet and results in a movement of the split location (weak point in the sheet) from that observed with standard papermaking approaches.

Example 1

Figure 3:
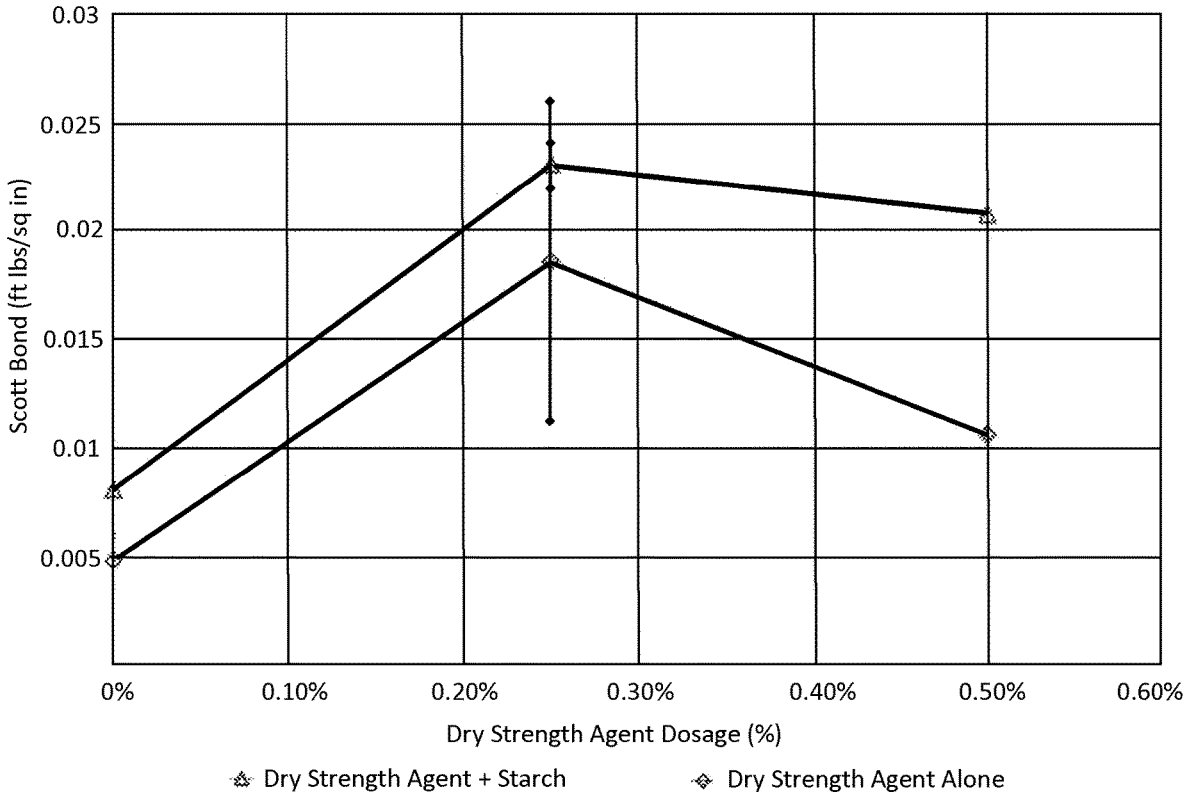
FIG. 3 is a graph illustrating a synthetic dry strength dose response curve for Scott Bond strength values with uncooked starch and without uncooked starch, of a comparative embodiment and an embodiment in accordance with an embodiment herein.
Figure 4:
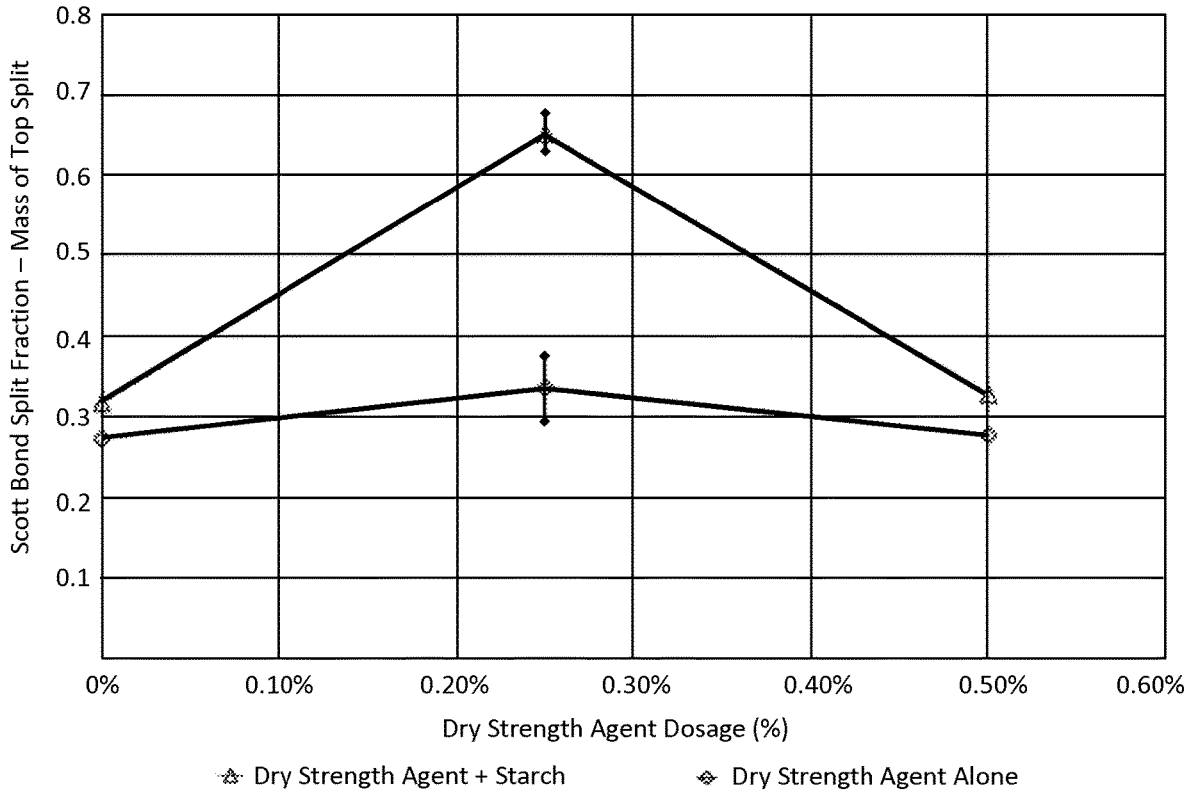
FIG. 4 is a graph illustrating the Scott Bond split location within the middle or base ply against the dose of a synthetic dry strength agent for the embodiments of FIG. 3.

In this experiment, Xelorex™ F 3000 was used as the synthetic dry strength agent, in some cases in combination with uncooked Raisamyl® 30067 starch. The starch was applied at a constant dose of 0.75 g/m$^2$ and added as a component of the foam formulation. The synthetic dry strength agent was dosed at three levels, as actives based on the dry weight of the simulated middle ply portion of the two-ply sheet. Foam was applied at a liquid add-on level of 122 g/m$^2$ of a 70% air content foam. Two graphs are presented comparing the results from addition of the synthetic dry strength agent, with and without the uncooked starch. FIG. 3 shows results from the synthetic dry strength agent dosed alone and results of the dry strength agent plus the constant dose of uncooked starch. The addition of both the uncooked starch and the synthetic dry strength agent increase the value of the Scott Bond (a test of internal bonding) over the strength results obtained with the synthetic dry strength agent alone. FIG. 4 shows that the addition of the synthetic dry strength agent alone (the lower line) does not change the location of the split in the Z-direction, the split remains at or near the interface of the two sheet plies. The combination of uncooked starch and synthetic dry strength agent tends to move the split zone deeper into the middle ply of the sheet. Since the Z-direction split does not change with dry strength agent alone, we confirm the failure point is at the top ply to middle ply bond without uncooked starch. With the addition of uncooked starch, the Z-direction failure point moves deeper into the sheet, well below the top ply-middle ply zone, as the dose of synthetic dry strength agent increases. This shows that the joint is now stronger than the middle ply internal bonding without the addition of the synthetic dry strength agent, while the synthetic dry strength agent clearly increases the middle ply internally, and the overall Scott Bond value is much higher.

Example 2

Figure 6:
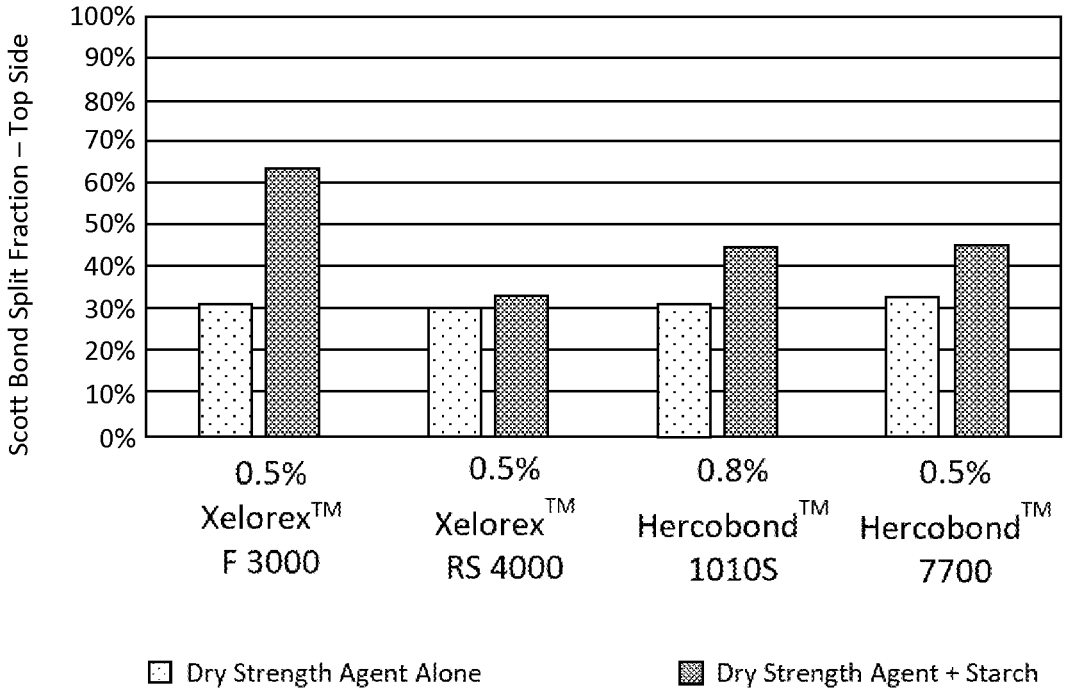
FIG. 6 is a graph illustrating Scott Bond split location within the middle or base ply for the embodiments of FIG.

Two-ply sheets were made as in the previous example, with a single dose level of four synthetic dry strength agents, alone and with 0.75 g/m$^2$ of uncooked starch, all applied at a level of 122 g/m$^2$ foam addition to the sheet (70% air content). FIG. 5 shows the Scott Bond strength with each synthetic dry strength agent with and without uncooked starch. In all cases, the Scott Bond test value is much higher with the combination of a synthetic dry strength agent plus uncooked starch than without the uncooked starch. FIG. 6 shows the position of the split in the Z-direction, by indicating the mass percent in the top portion of the broken sheet. The split is at the same location in the combined sheet for all sheets with synthetic dry strength agents alone, at 30% of the sheet thickness, which is at or near the ply bond area. The addition of uncooked starch increases the depth of the split in the Z-direction, with the greatest change in the split location for the synthetic dry strength agents having the largest increase in the Scott Bond value. This again shows that the starch is reinforcing the ply bond joint only, while the synthetic dry strength agent is reinforcing the middle ply internally.

FIG. 7 and FIG. 8 show all the same trends as FIG. 5 and FIG. 6, respectively, but quantified by the Z-Direction Tensile Strength (ZDT) test, another commonly used test of internal bonding for paper and paperboard.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A method for manufacturing a multi-ply paper product, the method comprising:

producing a foam of water, air, a foaming agent, uncooked starch particles, and dissolved molecules of a dry strength agent;

applying the foam to a first surface of a base embryonic ply web, wherein the base embryonic ply web has a second surface opposite the first surface;

providing an applied embryonic ply web having a first surface and an opposite second surface and contacting the first surface of the base embryonic ply web with the first surface of the applied embryonic ply web at an interface to form a combined ply web; and selectively applying vacuum pressure to the second surface of the base embryonic ply web to retain the uncooked starch particles on or near the first surface of the base embryonic ply web, to draw the dissolved molecules of the dry strength agent into the base embryonic ply web and/or to the first surface of the applied embryonic ply web to retain the uncooked starch particles in the interface and to draw the dissolved molecules of the dry strength agent into the applied embryonic ply web, wherein the selectively applying vacuum pressure physically retains the uncooked starch particles by filtration at or near the first surface of the base embryonic ply web while drawing the dissolved molecules of the dry strength agent into the base embryonic ply web to a greater depth than the retained uncooked starch particles.

2. The method of claim 1 wherein selectively applying vacuum pressure to the second surface of the base embryonic ply web to retain particles of the uncooked starch on or near the first surface comprises applying vacuum pressure to the second surface of the base embryonic ply web at least before contacting the first surface of the base embryonic ply web with the first surface of the base embryonic ply web of the applied embryonic ply web.

3. The method of claim 1 further comprising providing a third embryonic ply web having a first surface and an opposite second surface and contacting the first surface of the third embryonic ply web with the second surface of the base embryonic ply web, wherein the combined ply web comprises the applied embryonic ply web, the base embryonic ply web, and the third embryonic ply web.

4. The method of claim 3 further comprising applying the foam to the second surface of the base embryonic ply web, to the applied embryonic ply web, and/or to the third embryonic ply web.

5. The method of claim 1 further comprising pressing the combined ply web in one or more stages to further distribute the molecules of the dry strength agent within the base embryonic ply web and/or within the applied embryonic ply web.

6. The method of claim 1 further comprising drying the combined ply web under conditions of sufficient ply moisture, temperature, and time to cause the particles of the uncooked starch to gelatinize, to distribute within the interface, and to increase ply bond strength between the base embryonic ply web and the applied embryonic ply web.

7. The method of claim 1 wherein producing the foam of water, air, a foaming agent, the uncooked starch particles, and the dissolved molecules of the dry strength agent comprises producing the foam with a foam density of from 50 to 300 g/L.

8. The method of claim 1 wherein the particles of uncooked starch have a mean maximum dimension of from 5 to 50 microns, and at a foam coverage level of from 30 to 300 wet g/m$^2$.

9. The method of claim 1 wherein applying the foam to the first surface of the base embryonic ply web comprises applying the foam to the base embryonic ply web such that a dosage of the uncooked starch to the base embryonic ply web is from 0.1 to 4 g/m$^2$.

10. The method of claim 1 wherein applying the foam to the first surface of the base embryonic ply web comprises applying the foam to the base embryonic ply web such that a dosage of the dry strength agent to the base embryonic ply web is from 0.05 to 5 g/m$^2$.

11. The method of claim 1 wherein, when applying the foam to the first surface of the base embryonic ply web, the base embryonic ply web is from 5 to 20% solids.

12. The method of claim 1 wherein the foam is produced from the water, the air, the uncooked starch particles, the dissolved molecules of the dry strength agent, and the foaming agent.

13. The method of claim 1 wherein:

the uncooked starch particles have a mean particle size of 5 to 50 microns; and selectively applying vacuum pressure physically retains the uncooked starch particles by filtration at or near the interface between the applied embryonic ply web and the base embryonic ply web while drawing the dissolved molecules of the dry strength agent deeper into an interior region of the base embryonic ply web beyond the interface, such that the combined ply web, after drying, exhibits a Scott Bond failure location within the interior of the base embryonic ply web rather than at the interface between the base embryonic ply web and the applied embryonic ply web.

14. The method of claim 1 wherein the dry strength agent is selected from the group consisting of: acrylamide-diallyldimethylammonium chloride copolymers; glyoxylated acrylamide-diallyldimethylammonium chloride copolymers; vinylamine containing polymers and copolymers; polyamidoamine-epichlorohydrin polymers; glyoxylated acrylamide polymers; polyethyleneimine; acryloyloxyethyltrimethyl ammonium chloride; and combinations thereof.

15. The method of claim 1 wherein the foaming agent is selected from the group consisting of: nonionic foaming agents, zwitterionic foaming agents, amphoteric foaming agents, polyvinyl alcohol, and combinations thereof.

16. The method of claim 1 wherein the foam has an air content of from 70% to 90% based on a total volume of the foam.

17. The method of claim 1 wherein the foam comprises gas bubbles having a mean maximum dimension of from 50 to 150 micrometers.

18. The method of claim 1 wherein the combination of the uncooked starch retained at the interface and the dry strength agent distributed within the base embryonic ply web provides a synergistic improvement in Scott Bond strength greater than the sum of improvements from each component alone.

19. The method of claim 15 wherein the foaming agent comprises polyvinyl alcohol having a degree of hydrolysis of between 70% and 99.9% and a number average molecular weight of from 5,000 to 400,000.

20. A method for manufacturing a multi-ply paperboard product, the method comprising:

forming a base embryonic ply web by discharging a first aqueous paper stock from a first headbox onto a moving first forming fabric, the first aqueous paper stock comprising pulp fibers, wherein water drains through the first forming fabric to increase the consistency of the first paper stock to form the base embryonic ply web, the base embryonic ply web having a first surface and an opposite second surface;

dewatering the base embryonic ply web to a consistency of from 6 to 12% dry solids;

generating a foam comprising water, air, a foaming agent, uncooked starch particles having a mean maximum dimension of from 5 to 50 microns, and dissolved molecules of a dry strength agent;

applying the foam to the first surface of the base embryonic ply web while the base embryonic ply web is carried on the first forming fabric;

applying vacuum pressure to the second surface of the base embryonic ply web to draw the foam into the base embryonic ply web, wherein the vacuum pressure physically retains the uncooked starch particles by filtration at or near the first surface while drawing the dissolved molecules of the dry strength agent into the base embryonic ply web to a greater depth than the retained uncooked starch particles;

forming an applied embryonic ply web on a second forming fabric by discharging a second aqueous paper stock from a second headbox;

combining the base embryonic ply web with the applied embryonic ply web at a combining roll to form a combined ply web, wherein the first surface of the base embryonic ply web contacts a surface of the applied embryonic ply web at an interface; and drying the combined ply web under conditions of sufficient moisture, temperature, and time to gelatinize the uncooked starch particles retained at the interface and form an adhesive ply bond between the base embryonic ply web and the applied embryonic ply web.

* * * * *